US008220961B2

(12) United States Patent
Belknap et al.

(10) Patent No.: US 8,220,961 B2
(45) Date of Patent: Jul. 17, 2012

(54) LED LIGHT FIXTURE

(75) Inventors: Lee J. Belknap, Hendersonville, NC (US); James H. Toney, Jr., Canton, NC (US); Gary Allen Steinberg, Flat Rock, NC (US); Rodney Jonathan Waters, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 256 days.

(21) Appl. No.: 12/615,967

(22) Filed: Nov. 10, 2009

(65) Prior Publication Data

US 2011/0110081 A1 May 12, 2011

(51) Int. Cl.
*F21S 4/00* (2006.01)

(52) U.S. Cl. ..... 362/249.02; 362/240; 362/241

(58) Field of Classification Search ..... 362/147, 362/217.01, 217.02, 217.04, 217.05, 217.07, 362/218, 240, 241, 244–247, 249.02, 294, 362/297, 304, 305, 373
See application file for complete search history.

(56) References Cited

U.S. PATENT DOCUMENTS

| | | | | |
|---|---|---|---|---|
| 6,793,369 | B2 | 9/2004 | Calzaretta et al. | |
| 6,948,840 | B2 | 9/2005 | Grenda et al. | |
| 7,217,009 | B2 | 5/2007 | Klose | |
| 7,461,952 | B2 | 12/2008 | Trenchardl et al. | |
| 7,588,355 | B1 | 9/2009 | Liu et al. | |
| 7,611,264 | B1 * | 11/2009 | Chang et al. | 362/249.02 |
| 7,665,866 | B2 * | 2/2010 | Mayer et al. | 362/297 |
| 7,887,216 | B2 * | 2/2011 | Patrick | 362/218 |
| 2006/0209541 | A1 * | 9/2006 | Peck | 362/247 |
| 2007/0002572 | A1 * | 1/2007 | Ewig et al. | 362/470 |
| 2008/0278957 | A1 * | 11/2008 | Pickard et al. | 362/373 |
| 2009/0262543 | A1 * | 10/2009 | Ho | 362/373 |
| 2009/0303715 | A1 * | 12/2009 | Takasago et al. | 362/235 |
| 2010/0172152 | A1 * | 7/2010 | Boonekamp | 362/609 |
| 2011/0188233 | A1 * | 8/2011 | Josefowicz et al. | 362/158 |

FOREIGN PATENT DOCUMENTS

| | | | |
|---|---|---|---|
| EP | 2020564 | A1 | 2/2009 |
| WO | 2008/146229 | A2 | 12/2008 |

OTHER PUBLICATIONS

WO Search Report issued in connection with corresponding WO Patent Application No. US10/49051 filed on Sep. 16, 2010.

* cited by examiner

*Primary Examiner* — Hargobind S Sawhney
(74) *Attorney, Agent, or Firm* — Fay Sharpe LLP

(57) ABSTRACT

An LED light fixture and methods are provided in which the light from central portions of the LED light sources are reflected to illuminate areas on the periphery of an associated area, while less intense light from the sides of the LED light sources illuminate interior portions of the associated area to produce a uniform illumination, both horizontally and vertically, while minimizing direct glare from the light sources. The LED light fixture includes a heat sink having cooling fins on the periphery of the housing.

25 Claims, 9 Drawing Sheets

LED LIGHT FIXTURE

BACKGROUND OF THE DISCLOSURE

This disclosure relates to lighting fixtures, and more particularly to lighting fixtures that employ a light source which includes distinct, multiple light sources that collectively provide a desired, adequate lumen output in a desired photometric pattern.

Light fixtures have been employed to provide illumination for a wide variety of applications including, for example, parking garages to increase safety. Recently, light emitting diode (LED) technology has sufficiently advanced that LEDs may be used as the light source for these types of light fixtures. One challenge created by LED's is the dissipation of heat from the LED's. Heat has at least two detrimental effects on an LED. First, light output is inversely proportional to the junction temperature of an LED, thus the higher the temperature, the less light emitted by the LED. Second, the life span of the LED is also inversely proportional to the junction temperature of an LED, so the higher the temperature, the quicker the LED degrades over time. Therefore, the heat created when the LED produces light must be dissipated to improve the light output and life span of the LED. Conventional LED light fixtures often include heat sinks with fins which are grouped together and protrude vertically from a top of the fixture. However, this method and arrangement may stifle airflow, which is an important factor in dissipating heat. This is especially true when mounting the fixture close to or against the ceiling. Also, physical obstructions, e.g., a bird nest, may be situated on a top surface created by the fins, and the nest insulates the fins which reduces the ability to dissipate the heat generated by the LEDs and drivers.

Further, a uniform illumination is desired in lighting applications to reduce shadows and glare. Some conventional light fixtures for parking garages create bright portions (usually close to the center of the associated area or nadir), and dim portions (usually near the periphery of the associated area). Conventional light fixtures also may adversely impact vision by producing glare. Thus there is a continuing need for an LED light fixture which reduces glare, uniformly lights an associated area, and effectively dissipates the heat generated by the LED light source.

SUMMARY OF THE DISCLOSURE

The present disclosure provides a light emitting diode (LED) light fixture and control techniques to effectively dissipate heat generated by the LEDs and to uniformly illuminate an associated area, both horizontally and vertically, while reducing direct glare from the LED light sources.

An LED light fixture is disclosed, which includes a housing having a central portion, a bottom portion and an internal surface. An LED strip received in the housing, which includes an LED light source mounted to a circuit board, and preferably angled between about thirty and sixty degrees from vertically downward. A heat sink is provided to dissipate heat generated by the LED light sources and a power circuit is included to provide power to the LED light sources. An optical module connected to the housing includes both a reflective portion which reflects a first portion of the light from the LED light source and openings which allow a second portion of the emitted light from the LED light source to pass through, where both the first and second portions contribute to illuminating an associated area.

In an exemplary embodiment, the LED light fixture includes a lens along a bottom portion of the housing. The lens may connect to the housing via a hinge which allows the lens to open and facilitate easy access to the center portion of the housing for maintenance.

The lens may include a prism which reflects and refracts the light from the LED light source.

The LED light sources may be vertically staggered along the horizontal axis of the LED strip, or alternatively edges of an optical module are irregularly shaped in a diffusing formation. The prism of the lens, the staggering of the LED light sources, and the irregular edge of the optical module blend the light from the LED light sources to create a uniform illumination of the associated area.

The heat sink preferably includes a thermal pad which conducts heat away from the LED light source to heat dissipating fins. Because the LED strips are angled toward the center, the fins may be advantageously angularly placed on the periphery of the housing. The angled fins prevent birds from nesting on the fixture which eliminates the need for a guard or cage. Also, the angled fins allow better, vertical, airflow across the fins.

A method is provided for illuminating an associated area which includes providing light emitting diodes (LED) as a light source disposed in a generally polygonal pattern, and angling the LEDs about thirty to sixty degrees from vertically downward.

The method may further include reducing the direct glare from the LEDs by blocking direct light from a central portion of the LEDs, for example, reflecting light from a central portion of the LEDs.

The method may additionally include refracting light from the LEDs, passing light from a side portion of the LEDs via an irregular pattern, staggering the LEDs along a horizontal axis within the lighting unit, or any combination thereof.

One benefit of the present disclosure relates to shielding viewers from direct LED glare.

Still another benefit is associated with directing light toward extremities of a light pattern where light is most needed, and the ability to precisely aim light from the small LED light sources.

Yet another benefit resides in the use of one or more of diffuse surfaces, openings or slots in the reflectors, interruptions in diffuse zone edges, and housing and reflector edge modifications that solve problems associated with linear output from LEDs that are positioned in rows or precise light placement that would otherwise cause undesirable brightness in select areas and low brightness in other areas.

Still other benefits and advantages will become apparent upon reading the following description.

DETAILED DESCRIPTION OF THE PREFERRED EMBODIMENTS

Figure 1:
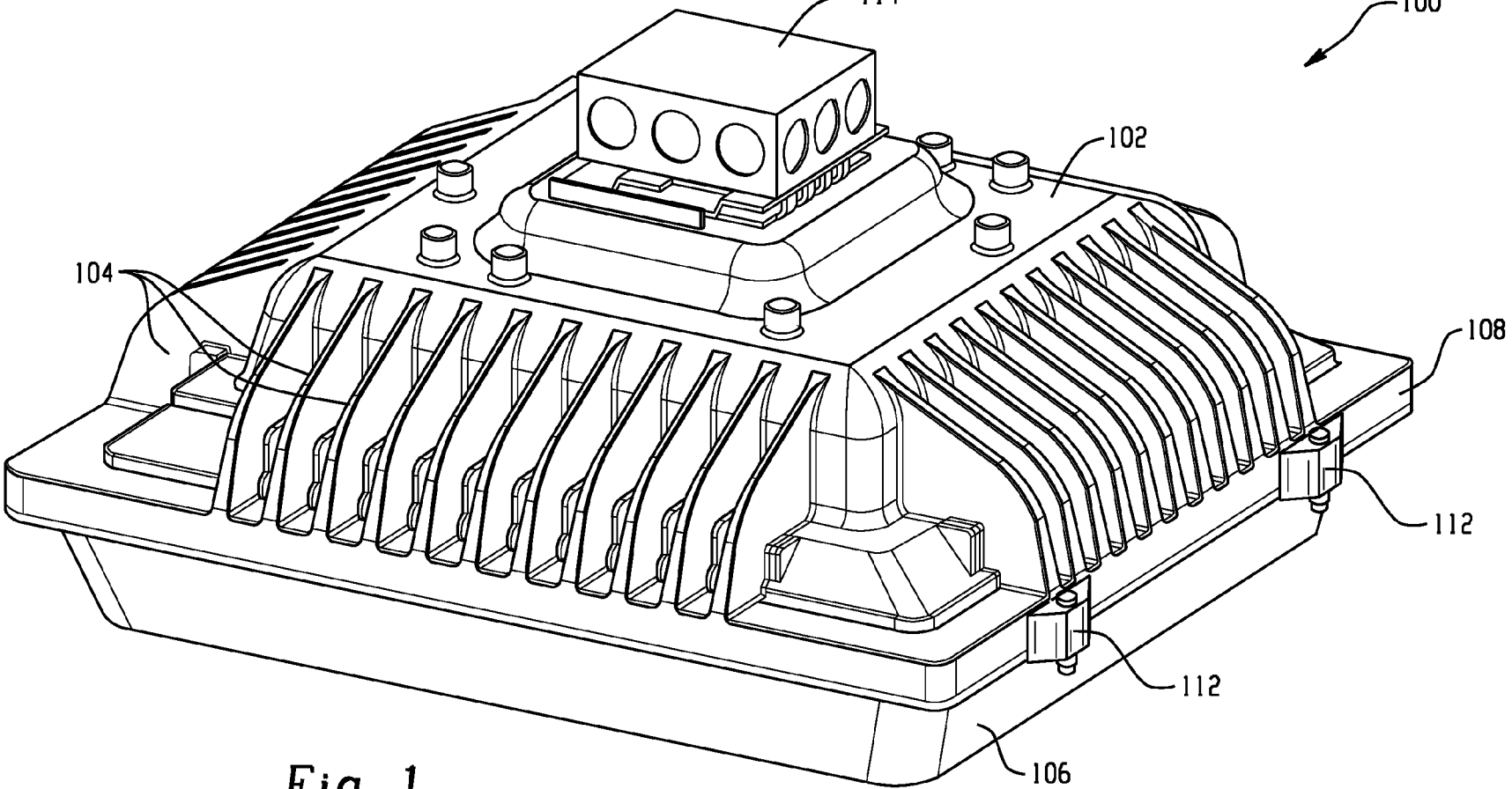
FIG. 1 is a top perspective view illustrating an exemplary light emitting diode (LED) light fixture.

Referring now to the drawings, where like reference numerals are used to refer to like elements throughout, and wherein the various features are not necessarily drawn to scale, the present disclosure relates to light emitting diode (LED) lighting and more particularly to a light fixture that employs LEDs as a light source for illuminating a parking garage and will be described with particular reference thereto. It will be appreciated, however, that the exemplary LED light fixtures described herein can also be used in other LED lighting applications and are not limited to the aforementioned application.

Where used in the following description, it will be understood that the term "nadir" is defined as the portion of the associated area directly below the LED light fixture. Likewise, "junction temperature" is the internal temperature of the LED light source, i.e. the temperature of the P-N junction internal to the semiconductor portion of the LED.

Figure 2:
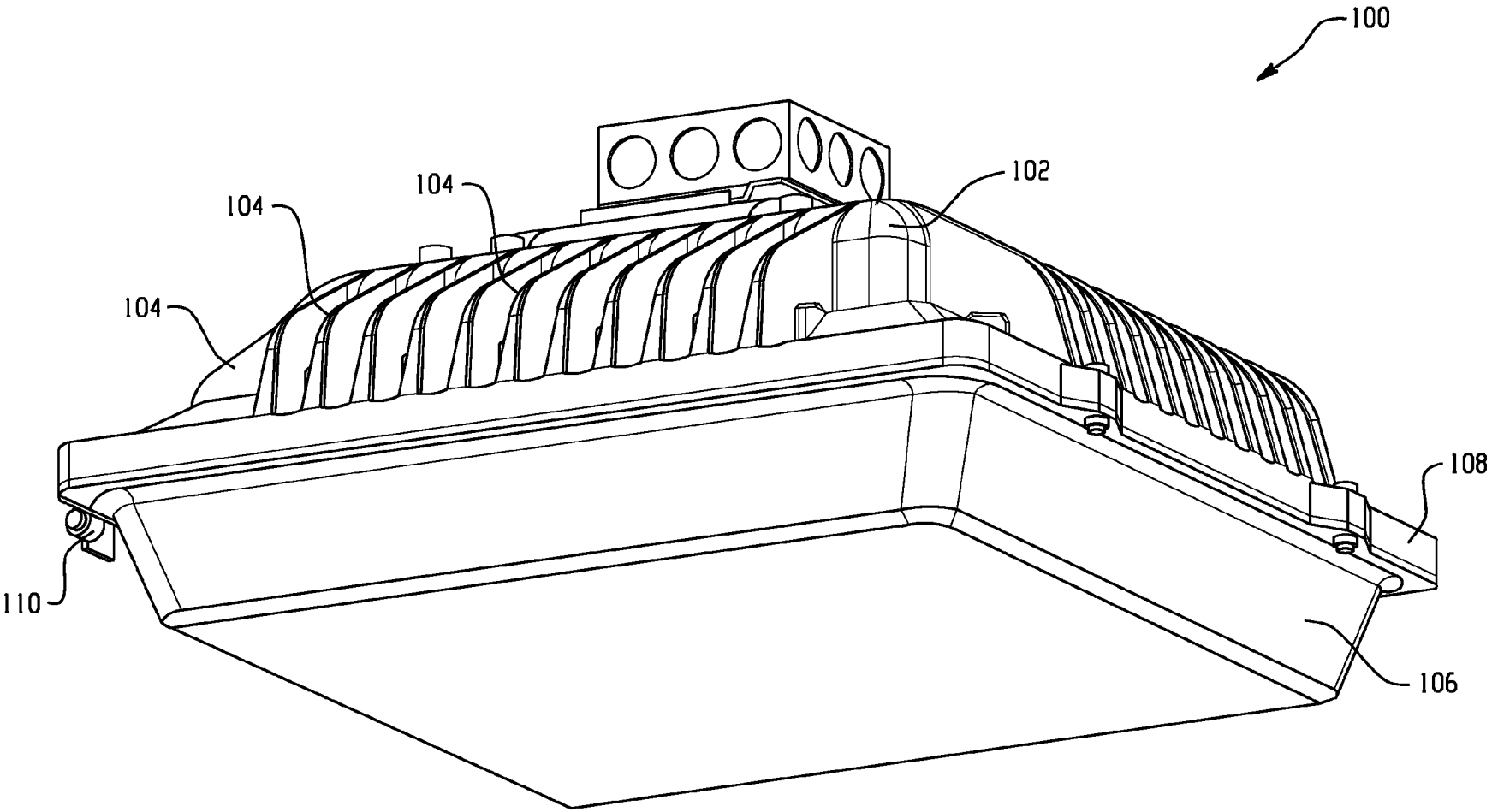
FIG. 2 is a bottom perspective view illustrating the exemplary LED light fixture of FIG. 1.

Turning initially to FIGS. 1 and 2, an exemplary embodiment of an LED light fixture 100 including a housing 102, fins 104 of a heat sink, and a lens 106 covering the bottom portion 108 of the housing 102 is illustrated. The fins are spaced along an upper surface of the housing, preferably situated along an upper, outer peripheral portion where the fins do not interfere with light output from the fixture. The lens 106 is preferably a single piece polymeric or glass structure that covers a lower surface of the housing, and in the illustrated embodiment the lens has a parallelepiped conformation where perimeter sidewalls are relatively low height and the lower surface is a substantially planar surface, although other conformations may be used without departing from the scope and intent of the present disclosure. The lens is operatively connected to the housing 102 via a hinge(s) 110 along one edge of the bottom portion of the housing (FIG. 2) and secured into a closed position relative to the housing with one or more fasteners 112, shown here as being located opposite the hinge. When the fastener(s) 112 is engaged or inserted through the lens and housing, the lens 106 is secured to the housing 102 in an operative, closed position. When the fastener(s) 112 is removed or disengaged, the lens 106 may pivot along the hinge 110 to provide ease of access to an interior cavity or inside of the LED light fixture 100 while the hinge retains the lens to the housing during service of components internal to the housing. The light fixture in the illustrated exemplary embodiment has a generally polygonal periphery (e.g., rectangular or square) and has a relatively low height that allows the fixture to be mounted to a ceiling or upper support structure with the lens facing downwardly, for example, mounted to a ceiling of a parking garage or similar low bay structure. Again, different conformations are contemplated and the present disclosure should not be limited to the illustrated embodiment or to a structure that includes all of the described features. For example, this disclosure is equally applicable to a lens that is not hinge to the housing.

Figure 3:
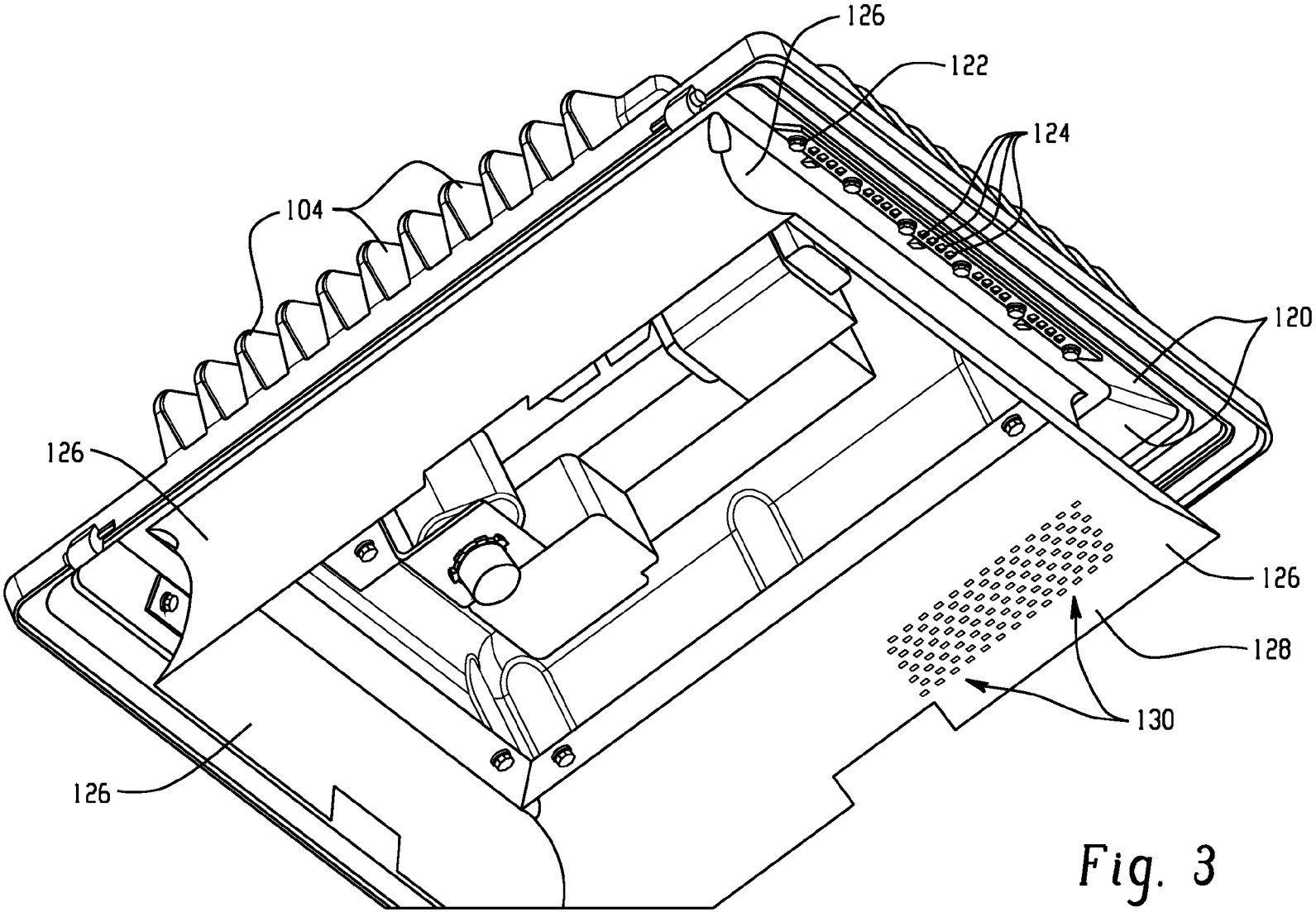
FIG. 3 is a bottom perspective view illustrating the exemplary LED light fixture of FIGS. 1-2 with the lens removed.

FIG. 3 shows the bottom of the LED light fixture 100 with the lens 106 and all internal covers, if any, completely removed for ease of illustration. The housing 102 includes an internal surface 120 which in the preferred arrangement is a series of internal surface portions arranged in a polygon such as in the shape of a rectangle or square. An LED strip 122 having a plurality of LEDs 124 is preferably mounted to each of the internal surfaces 120 at an angle of about thirty to sixty degrees, and more preferably about fifty degrees, with respect to vertically downward, toward the nadir. The LED strips are aimed inwardly so that a majority of the directional LED light output is initially directed inwardly and downwardly toward a central portion of the lens.

Figure 4:
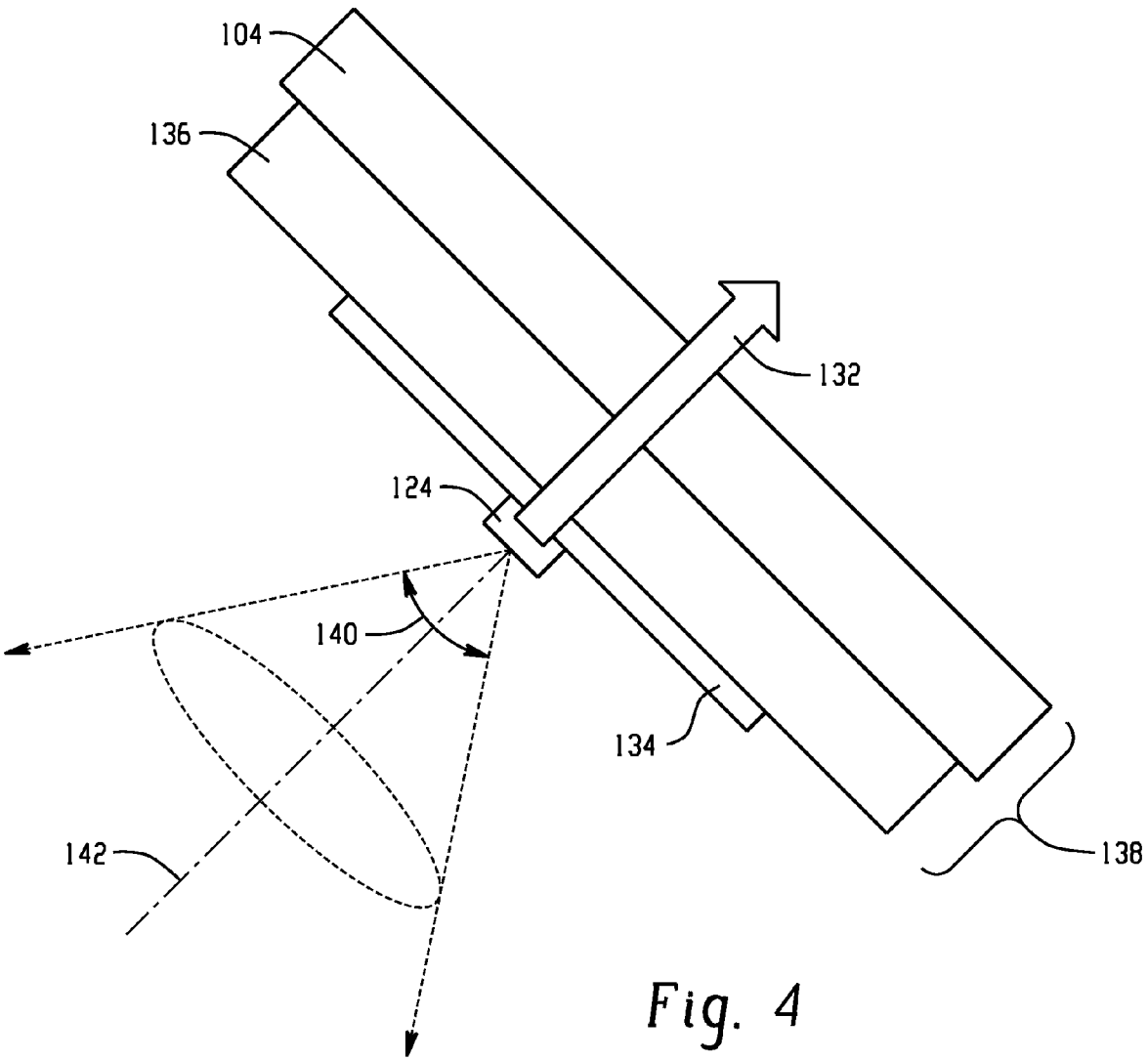
FIG. 4 is a schematic representation illustrating heat flow generated by the LED light source and a viewing angle of the light produced by the LED.

The light fixture 100 also preferably includes an optical module 126 which has reflectors 128 and openings 130 (or a reflector with openings formed therein) situated inwardly from the LED strips. As evident in FIG. 3, the reflector includes a like number of reflector portions (e.g., if there are four light strips arranged along the internal perimeter surfaces of the square-shaped housing, there are preferably four reflector portions situated inwardly from the light strips at a location(s) for redirecting light in a controlled manner, and particularly redirecting light from the brightest portions of the LEDs—namely, the central portions of the LEDs). This mounting arrangement leaves an enlarged central portion of the housing cavity open, i.e., the region of the housing disposed inwardly of the LED strips and reflector portions is generally open to allow ease of access to an upper internal region of the housing cavity. It will also be appreciated that, if desired, the open central portion of the housing cavity could incorporate a security camera, antenna, or the like. The open central portion is particularly desirable for servicing internal components of the light fixture FIG. 4 illustrates the flow of the heat generated by the LED 124 as represented by reference arrow 132. As mentioned above, the heat generated by the light emitting LED 124 must be dissipated to improve the desired light output and life span of the LED 124. The heat generated by the LED 124 is preferably channeled through the circuit board 134 of the LED strip 122 (FIG. 3) to a thermal pad 136. The thermal pad 136 then transfers or channels the heat to the fins 104 where airflow may aid in the dissipation of the heat to the external environment. As shown in FIG. 3, the LED strips 122 are mounted at an angle toward the nadir so the back of the LED 124 and the heat sink 138 (comprising the thermal pad 136 and the fins 104, are facing away from the nadir. This configuration allows the fins 104 to reside on an outer periphery of the housing 102, which allows for greater airflow across the fins 104 and spreads the heat out over a greater surface area than just a top portion of the housing 102. Also, this angle prevents other obstructions such as birds building nests on the heat sink 138 fins 104 themselves. Thus the exemplary LED light fixture 100 does not require a separate cage to prevent birds from nesting on the heat sink 138. Further, having the fins located on the outside allows the drivers and the LEDs to run in a hotter environment (i.e., at an elevated temperature) because the fins will effectively cool the structure, and allows the drivers to be mounted adjacent to the LEDs without restricting airflow to the cooling fins.

FIG. 4 further illustrates an angle 140 of the light emitted from the individual LEDs of the strip 124 at which an intensity of the light emitted is half the magnitude of the light emitted at the center 142 of the LED 124. Thus, the intensity of the light produced by an LED 124 is substantially greater at the center 142 of the LED 124 than the sides of the LED 124, and in fact light emitted from the strip 124 at angles outside of angle 140 (i.e., from the sides of the LEDs) has a further reduced intensity. By mounting the LED strip at an angle of about thirty to sixty degrees relative to vertical, in conjunction with one or more of the optical module features of FIGS. 5-10 below, the emitted light is better utilized and light can be directed to areas that historically are difficult to illuminate.

Figure 5:
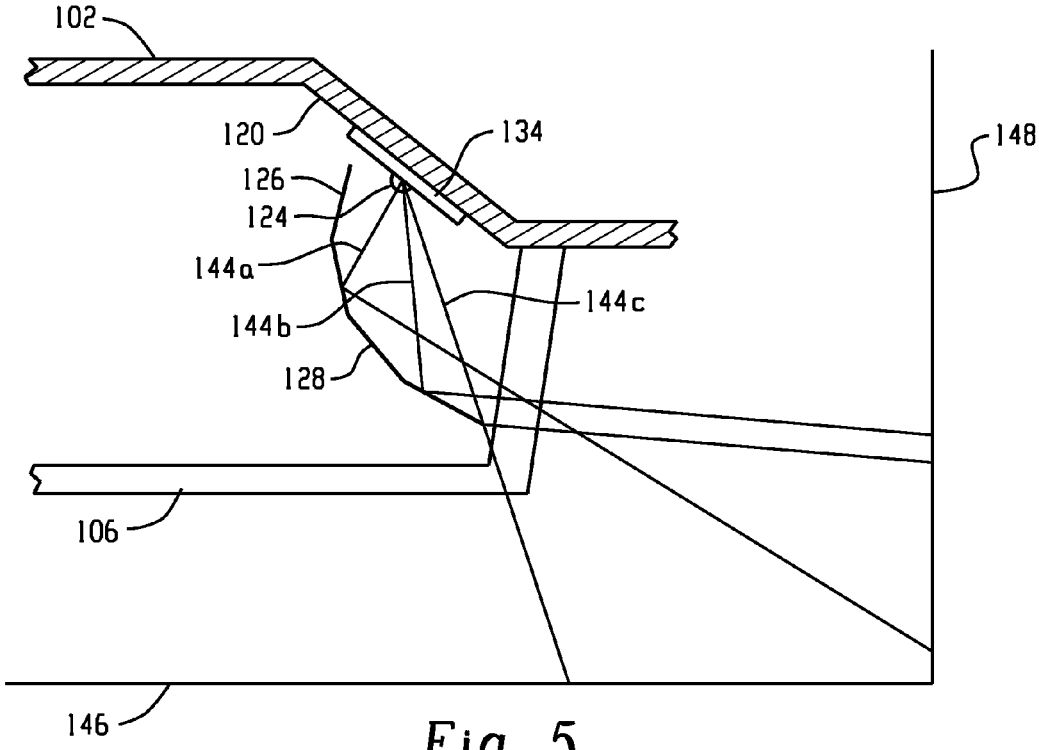
FIG. 5 is a schematic view illustrating light reflected from an LED to an associated area of the exemplary LED light fixture.

FIG. 5 illustrates an exemplary optical module 126 for controlling light 144 emitted by the LED light source 124. The reflective portion 128 of the optical module 126 reflects the higher and mid-level intensity light, 144*a* and 144*b* respectively, to the periphery of the associated area, while the optical module passes the lower intensity light 144*c* through the openings in the reflector portion. The higher intensity light 144*a* from the central portion of the LED light strip is initially directed toward the central portion of the light fixture, i.e., at an angle between approximately thirty to sixty degrees, and then redirected by the reflector 128 outward from the side of the lens 106 toward extremity regions where light is needed most. Similarly, light emitted from portions of the LEDs adjacent the central portion as represented by light ray trace 144*b* also is originally emitted toward the central portion or lower surface of the lens, and then redirected through the side of the lens toward extremity regions. Lower intensity light 144*c* from the edge of the LEDs passes through openings in the reflector, or misses the reflector entirely and assists in creating a more uniform illumination of the associated area below the light fixture. Thus, a portion of the emitted light 144 schematically illustrated in FIG. 5 is directed downwardly at an angle to illuminate the horizontal surface 146 and other portions of the light are redirected by the optical module 126 toward lower portions of the vertical surface 148 of the associated area.

Figure 6:
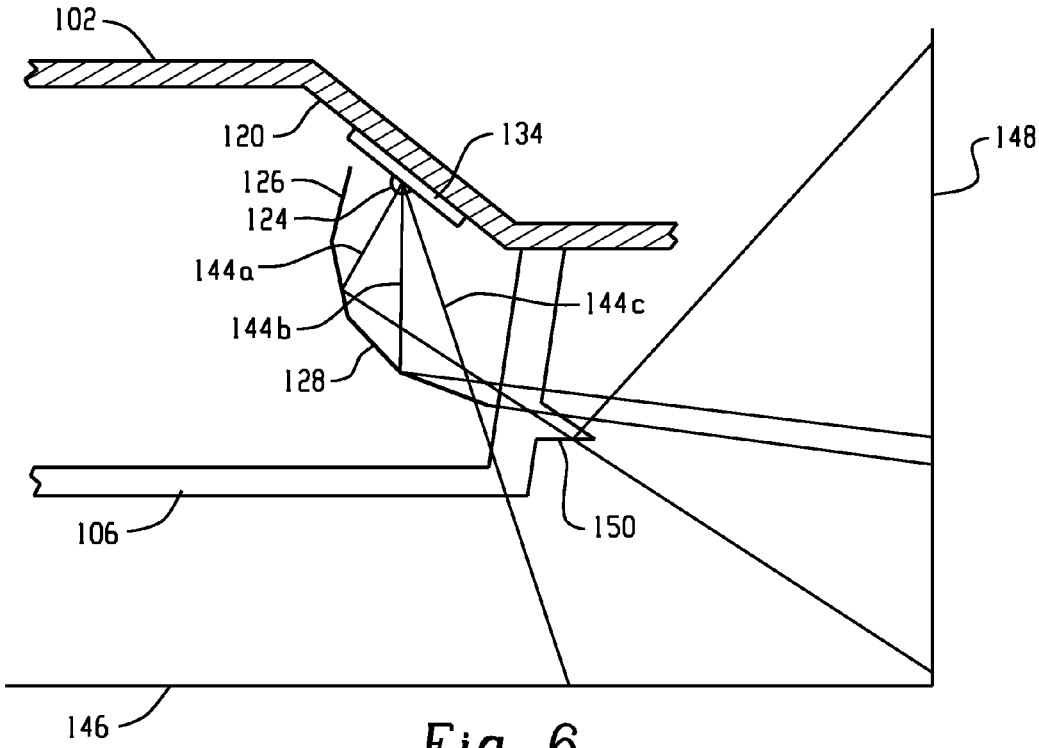
FIG. 6 is a schematic view illustrating light through a prism of the lens of the exemplary LED light fixture.
Figures 7, 8:
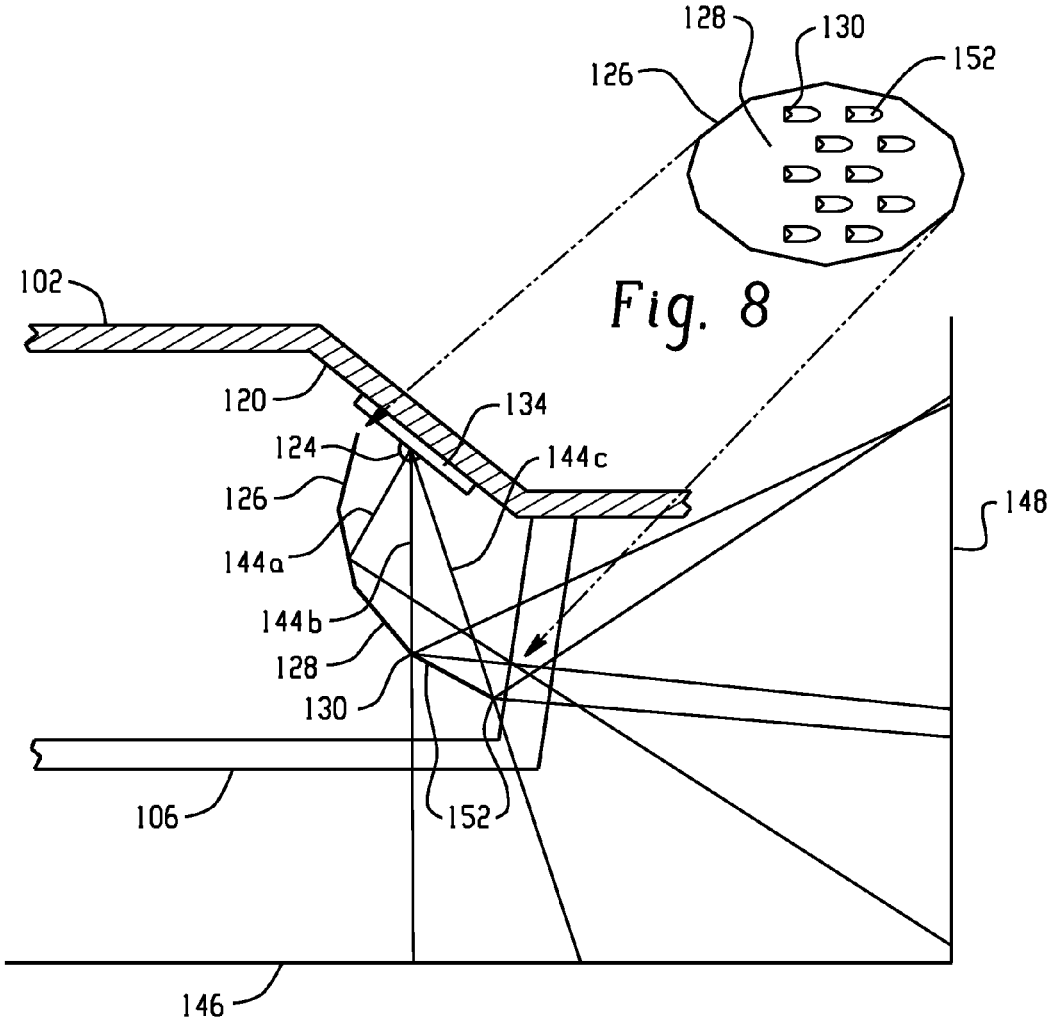
FIG. 7 is a schematic view illustrating a reflective light pattern from the reflector and the light through openings provided in the reflector and a magnified view of the optical module of the exemplary LED light fixture.
FIG. 8 is an enlarged view of a portion of the reflector of FIG. 7.

FIGS. 6-7 illustrate a modification to the structure so that a portion of light 144 may be reflected at an upward angle. More particularly, a portion of the light produced by the LED light source 124 is reflected by the exemplary optical module 126 through a prism 150. In the preferred arrangement, the prism is located in the lens 106. As in FIG. 5, the higher intensity light 144*a* from the central portions of the LEDs is directed toward the periphery and the lower intensity light 144*c* is passed to the nadir. Further, the higher intensity light 144*a* is also refracted and reflected through a prism 150 on the lens 106. This light ray trace 144*a*, reflected through the prism 150, is redirected by the prism at an upward angle to illuminate upper portions of the vertical surface 148 of the associated area.

FIG. 7 illustrates yet another exemplary optical module 126 reflecting and passing light 144 produced by an LED light source 124. The optical module 126 includes the reflective portions 128 discussed in reference to FIG. 5 and reflective tabs 152 which reflect the light 144 at an upward angle to illuminate in the vertical direction. It is also contemplated that the prism 150 of FIG. 6 and the tabs 152 of FIG. 7 are both used to reflect the light 144 in the upward direction. Reflection in the upward direction provides light to the ceiling or between ceiling beams to prevent the ceiling from being very dark. Also, by reflecting the light 144 produced by an inward facing LED light source 124, the heat sink fins 104 are able to be placed outward from the housing 102. If upward light were produced from upward or outward facing LEDs the heat sink fins 104 would face inwardly or below the circuit board 134, which may interfere with desired heat dissipation.

FIG. 7 further illustrates illuminating the nadir. As discussed in relation to FIG. 5, the lower intensity portion 144*c* of the emitted light is passed to the internal portions of the associated surface 146. Further, some of the mid-level intensity light 144*b* is passed through openings 130 within the optical module 126 to illuminate the central portion of the associated nadir area directly below the LED light fixture 100. The enlarged detail portion of the optical module 126 shown in FIG. 8 illustrates an exemplary orientation of the tabs 152 and openings 130. Many combinations of tabs 152 and openings 130 may be included on the optical module 126 including, but not limited to, no tabs, notches, openings within the tabs, irregularly shaped openings, openings next to the tabs, rows of tabs and rows of openings, and any combination thereof.

The higher intensity light illuminates the periphery of the associated area while the lower intensity light preferably illuminates the interior of the associated area. Because the direct higher intensity light is reflected and directed to a different direction, and the direct portion of the light that passes without reflection is a lower intensity, there is less apparent glare to a person exposed to light emitted from the light fixture.

Figure 11:
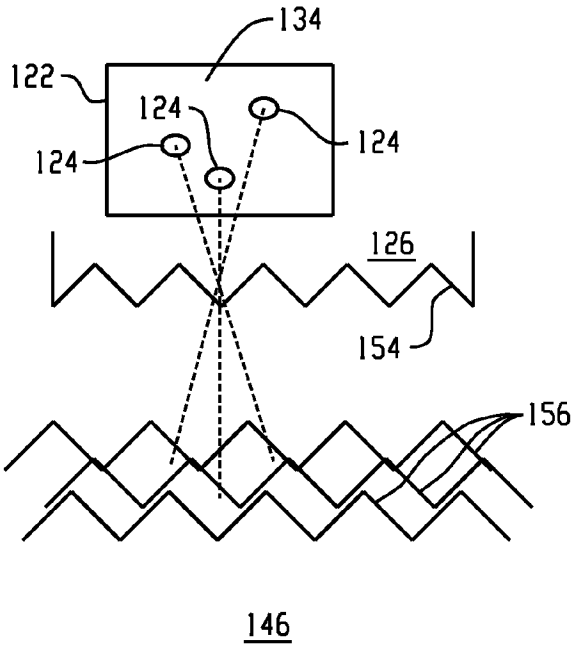
FIG. 11 is a schematic view illustrating vertical staggering of the LED light sources along the horizontal axis and the resultant effect of the staggering pattern on the light at an irregular edge of the reflector of the exemplary LED light fixture.
Figure 10:
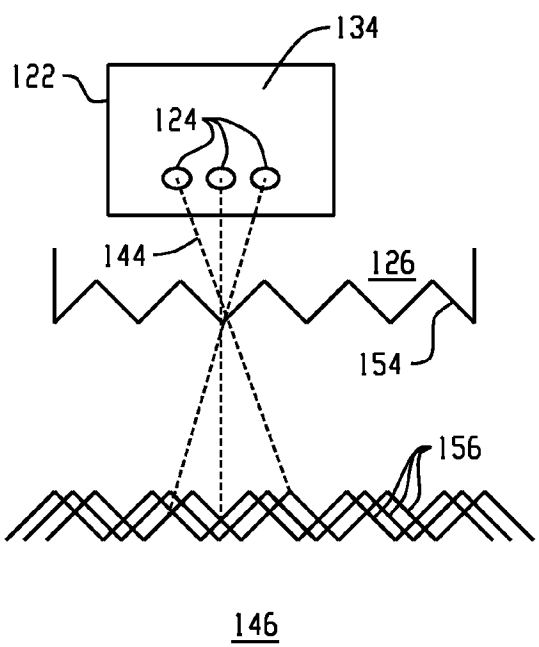
FIG. 10 is a schematic view illustrating multiple light sources producing light at an irregular edge of the reflector of the exemplary LED light fixture.
Figure 9:
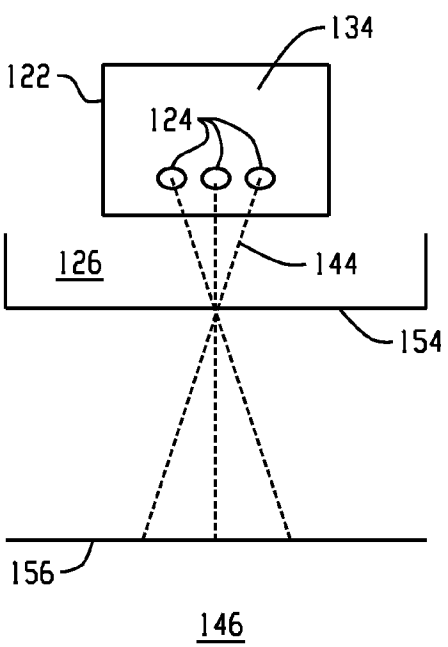
FIG. 9 is a schematic view illustrating multiple light sources producing light at a straight edge of the reflector of the exemplary LED light fixture.

FIGS. 9-11 illustrate blending the light 144 to produce a more uniform illumination. FIG. 9, for example, illustrates light 144 at the edge 154 of the optical module 126. The portion above the edge 154 represents the optical module 126, while the portion below the edge 154 represents open space. Of course, light 144 is blocked by the reflective portion 128 of the optical module 126 and is directed toward the open space. The resulting illumination pattern on the surface of the associated area 146 has a distinct edge 156 where the area inside (below in the figure) the edge 156 is illuminated and the area outside (above in the figure) the edge 156 is in shadows.

FIG. 10 illustrates the light 144 at the edge 154 of the optical module 126. In this embodiment, the edge 154 of the optical module 126 includes an irregular pattern, specifically a triangular wave pattern. The resulting illumination pattern includes a generally triangular wave pattern edge 156 for each LED light source 124 on the LED strip 122. The example shows three LEDs 124 which result in three edges 156 staggered horizontally. Where the edges 156 overlap, the light blends and creates a gradual fade to the shadows. The triangular wave pattern is merely one example of an irregular edge 154. Other edge shapes 154 include, but are not limited to, a saw tooth wave, a sinusoidal wave, a randomly jagged wave, a diamond pattern, openings close to the edge, irregularly shaped openings near the edge, still other similar patterns or random shapes, and any combination thereof.

FIG. 11 illustrates another embodiment for eliminating sharp edges in the beam pattern. For example, three LED light sources 124 are shown in staggered relation such that light emitted from the individual light sources passing through the edge 154 of the optical module 126. As in FIG. 10, three edges 156 of the illuminated pattern result, however, the edges 156 are further staggered, resulting in a further blending of the edge and eliminating sharp edges associated with linearly aligned LEDs. The vertical staggering of the LED light sources 124 blends the reflected light and the light passed through the openings 130, resulting in a more uniform illumination of the associated area.

Figure 12:
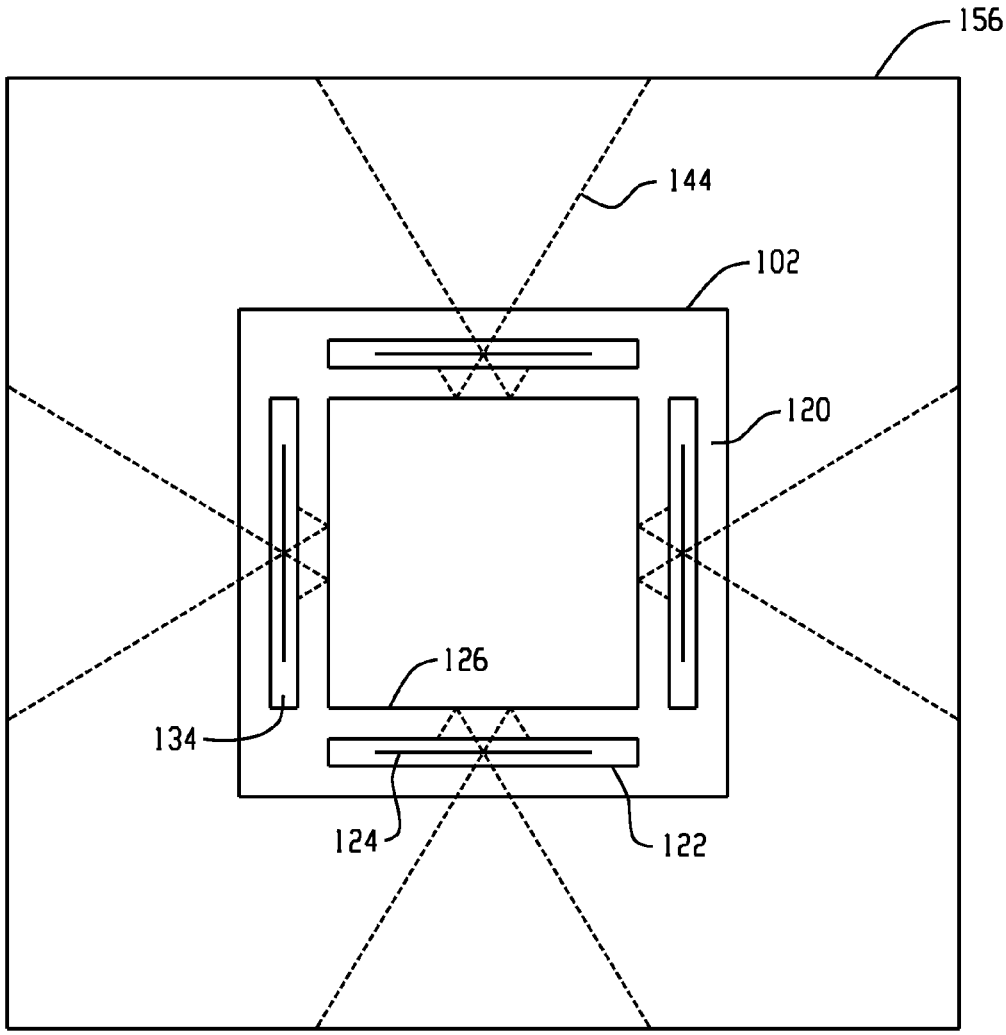
FIG. 12 is a schematic, bottom view illustrating a light pattern of the exemplary LED light fixture.
Figure 13:
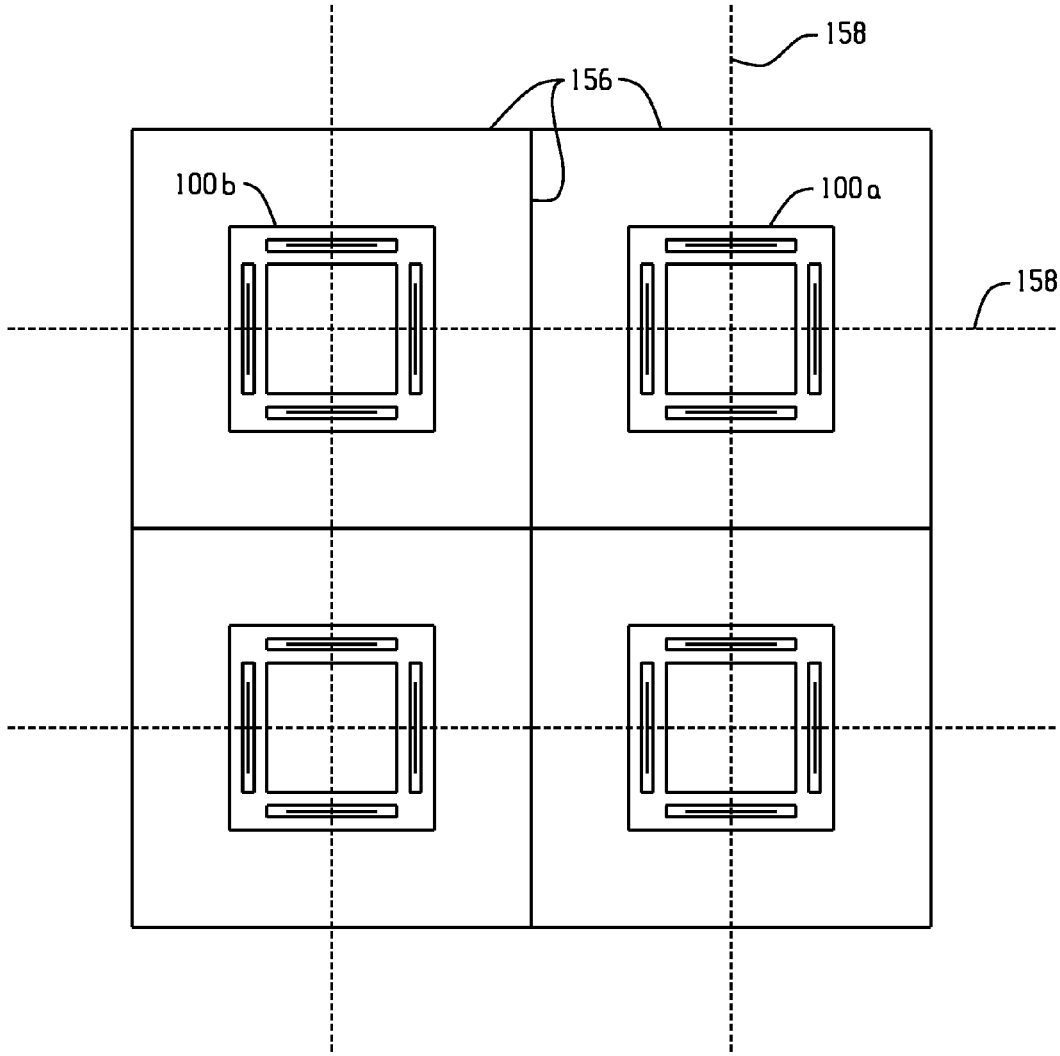
FIG. 13 is a schematic view showing an illumination pattern of four of the exemplary LED light fixtures.

FIGS. 12-13 illustrate the area illuminated by the exemplary LED light fixture 100. Different portions of the emitted light 144 are passed through, reflected, and/or refracted as described relative to the earlier embodiments. The resulting illumination pattern is generally rectangular in shape with blended edges 156. FIG. 13 illustrates lighting an associated area that is larger than the area which one LED light fixture 100 may illuminate. A grid is arranged with an LED light fixture 100 at each intersection. The generally rectangular illumination pattern of each light fixture allows for a substantially uniform distribution of light not only within the illuminated area of one fixture 100, but for the entire area. The blended edges 156 of the illumination pattern produced by an individual LED light fixture 100*a* may overlap the blended edge 156 of an illumination pattern produced by an adjacent LED light fixture 100*b*. The resulting overlapping area has a substantially more uniform illumination than prior arrangements. This provides a significant advantage over a circular light fixture, for example, which produces a circular illumination pattern and resulting overlapping areas are brighter than non-overlapping areas, and some areas within the associated area receive little or no light from the light fixtures. Of course, it will also be appreciated that the illumination patterns need not necessarily overlap, may overlap to varying degrees, or may adopt different illumination patterns without departing from the scope and intent of the present disclosure.

It is also contemplated that the present disclosure may include a dimming module (not shown) for reducing the intensity of the light 144 produced by LED light sources 124. Methods of reducing the intensity of the light 144 include, but are not limited to, pulse width modulation and dividing the voltage across the LED 124.

The above examples are merely illustrative of several possible embodiments of various aspects of the present disclosure, wherein equivalent alterations and/or modifications will occur to others skilled in the art upon reading and understanding this specification and the annexed drawings. Obviously, modifications and alterations will occur to others upon reading and understanding the preceding detailed description. It is intended that the present disclosure be construed as including all such modifications and alterations.

We claim:

1. A light assembly comprising:

a housing having a wall forming an internal cavity;

a light strip mounted on the peripheral wall and aimed inwardly for directing emitted light toward the internal cavity; and the housing including at least one reflective portion reflecting a first portion in a first direction away from the internal cavity and outwardly from the housing and including at least one opening passing a second portion of the emitted light a second direction different than the first direction, and toward the internal cavity.

2. The light assembly of claim 1:

wherein the light strip is received in the housing and includes at least one LED mounted on a circuit board operative to emit light, angled between about thirty to sixty degrees from vertically downward.

3. The light assembly of claim 2, wherein the reflective portion includes four internal surfaces arranged in a polygon and wherein the light assembly includes at least four LED strips associated with the four internal surfaces, respectively.

4. The light assembly of claim 2, further comprising a lens covering at least a bottom portion of the housing.

5. The light assembly of claim 4 further comprising a hinge operatively coupled between the housing and the lens to allow the lens to be selectively pivoted for access to the central portion of the housing.

6. The light assembly of claim 5, wherein the lens includes at least one prism.

7. The light assembly of claim 5 wherein the lens further includes a diffusion region.

8. The light assembly of claim 2, further comprising a heat sink operatively coupled to the LED strip and wherein the heat sink includes a thermal transfer material thermally coupled to the LED strip.

9. The light assembly of claim 2, wherein the optical module includes a reflective region operative to reflect light upwardly from the LED strip.

10. The light assembly of claim 2, wherein portions of the optical module include an irregular pattern operative to diffuse the light.

11. The light assembly of claim 2, wherein the light strip comprises a plurality of LEDs staggered vertically relative to one another along a generally horizontal axis of the LED strip.

12. The light assembly of claim 1 wherein the peripheral wall includes four wall portions disposed in a square or rectangular pattern and the light strip is an LED strip that includes at least four strip portions operatively mounted on the four wall portions, respectively.

13. The light assembly of claim 12 further comprising a corresponding square or rectangular-shaped lens through which the reflected emitted light is directed.

14. The light assembly of claim 1 wherein the reflector includes multiple openings in selected regions for permitting a reduced amount of the emitted light to pass through the reflector.

15. The light assembly of claim 1 wherein the light strip includes multiple LEDs disposed in substantially linear fashion therealong.

16. The light assembly of claim 15 further comprising a nonlinear optical feature to preclude light emission in an unmodified straight line.

17. The light assembly of claim 15 further comprising randomly offset LEDs from the substantially linear arrangement.

18. A method of illuminating an associated area comprising:

providing light emitting diodes (LED) as a light source disposed in a generally rectangular array such that the LEDs are aimed inwardly toward a central, vertical axis;

angling the LEDs inwardly and downwardly toward the central axis; reflecting a first portion of the light emitted by the LEDs in a first direction away from the central axis with a reflector; and permitting a second portion of the light emitted the LEDs to pass through at least one opening in the reflector in a second direction different than the first direction, and toward the internal cavity.

19. The method of claim 18 further comprising reducing direct glare from the LEDs by blocking direct light from a central portion of the LEDs with a reflector.

20. The method of claim 18 further comprising reflecting light emitted from a central portion of the LEDs.

21. The method of claim 18 further comprising refracting light from the LEDs.

22. The method of claim 18 further comprising staggering the LEDs along a horizontal axis within the lighting unit.

23. The method of claim 18 further comprising arranging the LEDs in strip portions in a polygon array and staggering the LEDs in each strip portion.

24. A light assembly comprising:

a housing having a peripheral wall forming an internal cavity, the peripheral wall includes four wall portions disposed in a square or rectangular pattern;

an LED light strip that includes at least four strip portions operatively mounted on an internal surface of the four wall portions, respectively for directing emitted light toward the internal cavity; and a reflector extending from the housing and reflecting the emitted light in a first direction away from the internal cavity and outwardly from the housing, the LED strips are angled between approximately thirty and sixty degrees from vertically downward the reflector including at least one opening for permitting a reduced amount of the emitted light to pass therethrough in a second direction different than the first direction, and toward the internal cavity.

25. The light assembly of claim 24 wherein the reflector includes portions that reflect the emitted light upwardly to illuminate regions external to the housing at angles greater than ninety degrees from vertically downward.

* * * * *